US008628294B1

(12) United States Patent
Liang

(10) Patent No.: US 8,628,294 B1
(45) Date of Patent: Jan. 14, 2014

(54) TURBINE STATOR VANE WITH PURGE AIR CHANNEL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 441 days.

(21) Appl. No.: 13/111,106

(22) Filed: May 19, 2011

(51) Int. Cl.
*F01D 9/02* (2006.01)
*F01D 25/08* (2006.01)

(52) U.S. Cl.
USPC ..... 415/115; 415/116

(58) Field of Classification Search
USPC ..... 415/1, 115, 116; 416/1, 96 R, 97 R, 97 A
See application file for complete search history.

(56) References Cited

U.S. PATENT DOCUMENTS 4,820,116 A * 4/1989 Hovan et al. ..... 415/115
5,399,065 A * 3/1995 Kudo et al. ..... 415/115
5,488,825 A * 2/1996 Davis et al. ..... 60/806
5,591,002 A * 1/1997 Cunha et al. ..... 415/115
5,609,466 A * 3/1997 North et al. ..... 415/115
6,077,034 A * 6/2000 Tomita et al. ..... 415/110
6,089,822 A * 7/2000 Fukuno ..... 415/115
6,099,244 A * 8/2000 Tomita et al. ..... 415/115
6,217,279 B1 * 4/2001 Ai et al. ..... 415/110
6,264,426 B1 * 7/2001 Fukuno et al. ..... 415/115
6,402,471 B1 * 6/2002 Demers et al. ..... 416/97 R
6,416,284 B1 * 7/2002 Demers et al. ..... 416/97 R
6,761,529 B2 * 7/2004 Soechting et al. ..... 415/115
6,874,988 B2 * 4/2005 Tiemann ..... 415/115
7,008,185 B2 * 3/2006 Peterman et al. ..... 416/96 A
7,011,492 B2 * 3/2006 Schwartz et al. ..... 415/115
8,016,553 B1 * 9/2011 Liang ..... 415/174.5
8,192,145 B2 * 6/2012 Bacha et al. ..... 415/115
2003/0002979 A1 * 1/2003 Koschier ..... 415/115
2004/0062637 A1 * 4/2004 Dube et al. ..... 415/116
2005/0031445 A1 * 2/2005 McClelland ..... 415/115
2006/0005546 A1 * 1/2006 Orlando et al. ..... 60/782
2006/0233644 A1 * 10/2006 Guimbard et al. ..... 416/97 R
2007/0122281 A1 * 5/2007 Dervaux et al. ..... 416/97 R
2009/0068023 A1 * 3/2009 Liang ..... 416/97 R
2009/0324423 A1 * 12/2009 Liang ..... 416/97 R

* cited by examiner

*Primary Examiner* — Nathaniel Wiehe
*Assistant Examiner* — Wayne A Lambert
(74) *Attorney, Agent, or Firm* — John Ryznic

(57) ABSTRACT

A stator vane for an industrial turbine, the vane includes a serpentine flow cooling circuit for cooling of the airfoil, and a separate purge air channel to supply purge air to the rim cavities. The purge channel is formed as a separate channel from the serpentine flow channels so that the purge air is not heated by the hot metal and has smooth surfaces so that pressure losses is minimal.

10 Claims, 9 Drawing Sheets

TURBINE STATOR VANE WITH PURGE AIR CHANNEL

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a stator vane in an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

In the turbine section, cooling air used for the inter-stage housing is supplied through the stator vane. FIGS. 5 and 6 show two of the prior art methods of providing cooling air through the vane to the inter-stage housing located inside of the inner endwall or shroud of the stator vanes. In FIG. 5, cooling air from the first leg of a serpentine flow cooling circuit formed within the vane is bled off at an end of the first leg and passed through a hole formed within a cover plate. The hole in the cover plate can be sized to regulate the amount and pressure of the cooling air bled of from the first leg. In the FIG. 5 design, the root turn is located within the hot flow path through the vanes. In FIG. 6, the bleed off hole is located within a root turn of the serpentine circuit. In both of the FIG. 5 and FIG. 6 purge air circuits, the cooling air for the front rim cavity is used for the cooling of the airfoil leading edge region. Because of this, the purge air for the inter-stage housing is over-heated and root turn passage increases turbulence within the cooling air and thus induces uncertainties for the root turn losses. Because of the over-heated purge air for the inter-stage housing, the turbine section overheats resulting in a shorter engine life.

BRIEF SUMMARY OF THE INVENTION

A turbine stator vane with separate cooling air channels to supply cooling air to an inter-stage housing of the turbine. A separate serpentine flow cooling circuit is used for cooling of the airfoil of the stator vane so that the cooling air used for the inter-stage housing is not heated from the airfoil leading edge region. The cooling channel used for the inter-stage housing is located between adjacent legs or channels of the serpentine flow circuit and extends from the outer shroud to the inner shroud.

DETAILED DESCRIPTION OF THE INVENTION

Figure 1:
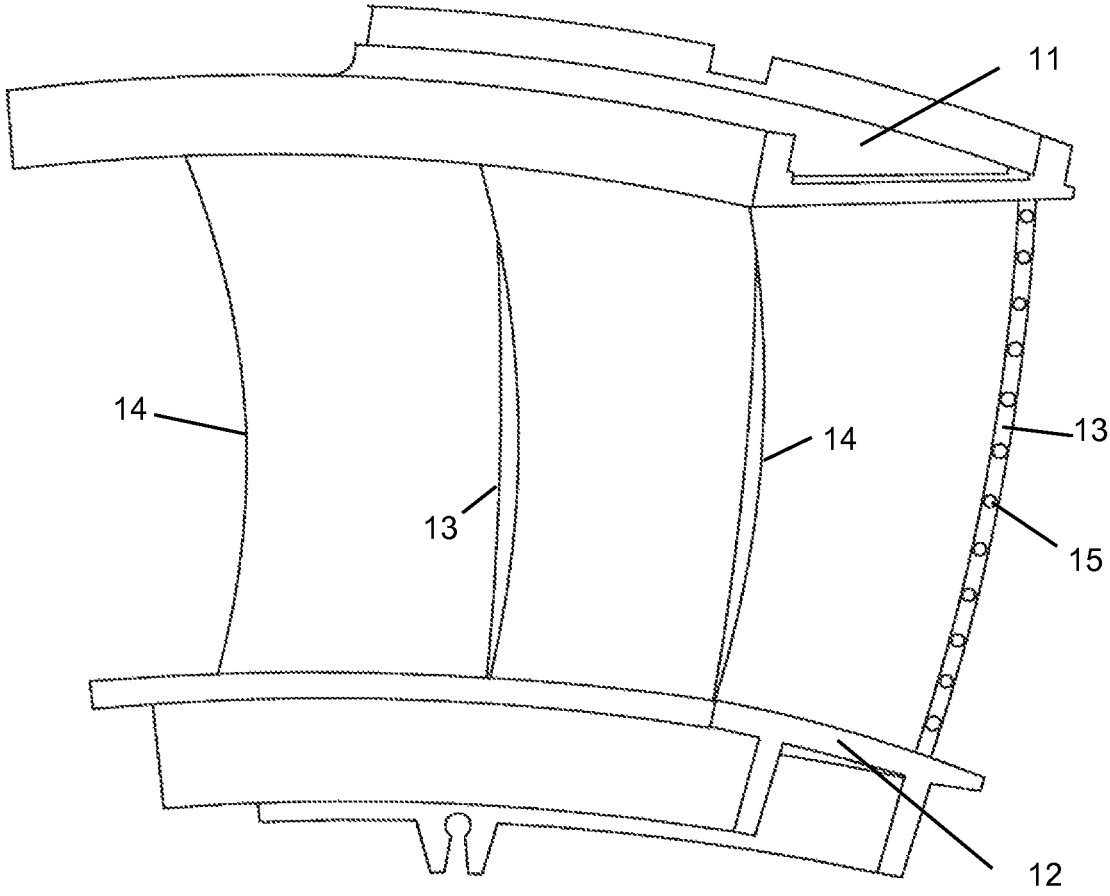
FIG. 1 shows a side view of a turbine stator vane segment of the present invention.

FIG. 1 shows a turbine stator vane segment in which the cooling circuit of the present invention is used. The cooling air circuit and purge air channel of the present invention is intended to be used in a large frame industrial gas turbine engine because of the requirement to provide cooling for an inter-stage housing in which a rim cavity is formed. The vane segment in FIG. 1 includes three airfoils extending between an outer endwall 11 and an inner endwall 12 where each airfoil includes a leading edge 14 and a trailing edge 13 with a row of exit cooling holes 15 opening on the trailing edge 13. However, the cooling air circuit and purge air channel of the present invention can be used in a single airfoil vane or an aero engine vane.

Figure 2:
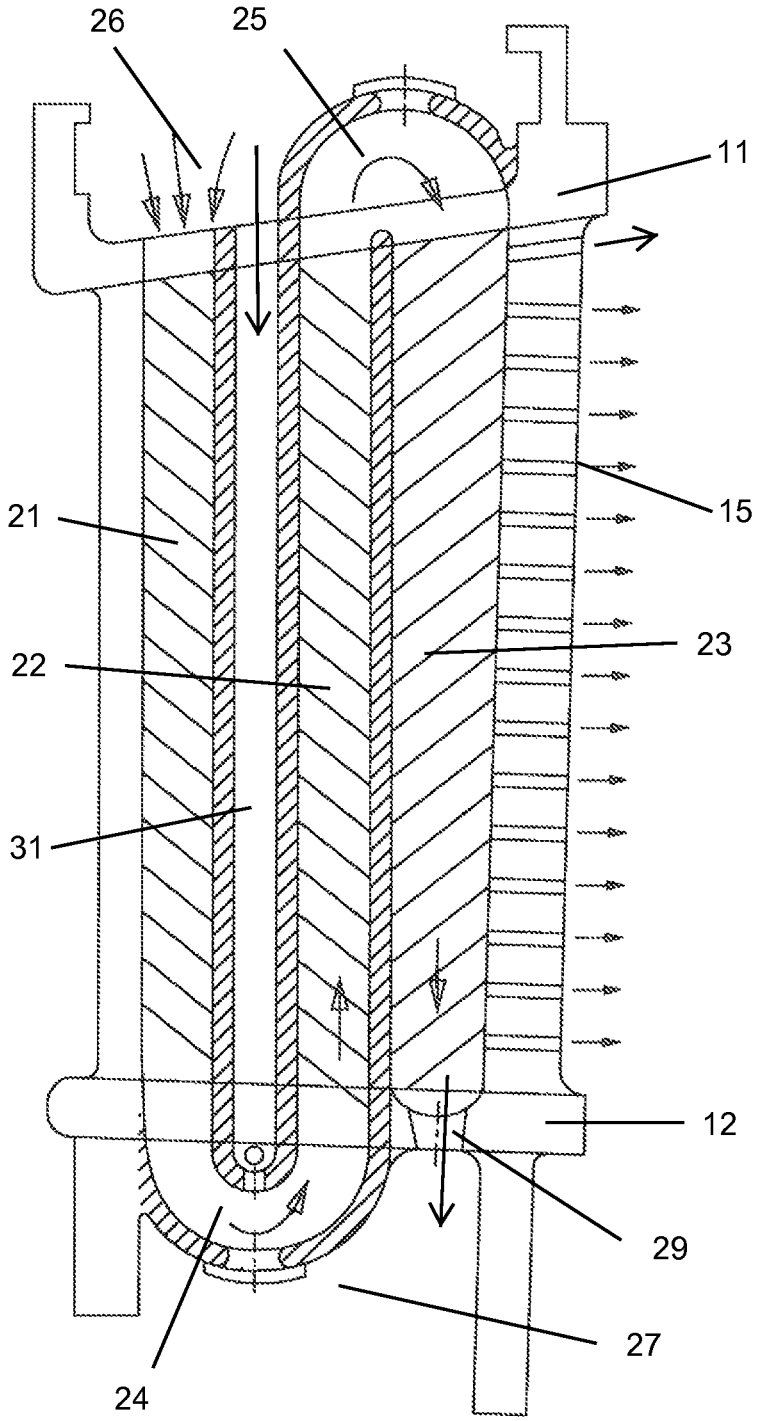
FIG. 2 shows a cross section view through the side of a vane of the present invention with the cooling circuits.

FIG. 2 shows the vane airfoil cooling circuit and purge air channel that includes a triple-pass or three-pass serpentine flow cooling circuit for the airfoil with a first leg 21 located along the leading edge, a second leg 22 connected to the first leg 21 through a lower turn channel 24, and a third leg 23 located adjacent to the trailing edge region and connected to the second leg 22 through an upper turn channel 25. The row of exit holes 15 is connected to the third leg 23. Trip strips are used in the legs 21-23 of the serpentine circuit to enhance the heat transfer effect. The two turn channels 24 and 25 are smooth surfaces without trip strips so that a pressure loss is minimal and a smooth flow of the cooling air between legs occurs. The end of the third leg 23 is connected by a print-out hole 29 which becomes a purge air hole to discharge additional purge air into the rim cavity 27.

The purge air channel 31 is located between the first leg 21 and the second leg 22 and forms a separate and independent cooling air channel from the serpentine flow circuit. Both the first leg 21 and the purge air channel 31 are connected to the impingement cavity 26 located above the outer endwall for cooling air supply. The purge air channel 31 is without trip strips to provide for a smooth surface so that pressure losses and the heat transfer rate is minimal.

Figure 3:
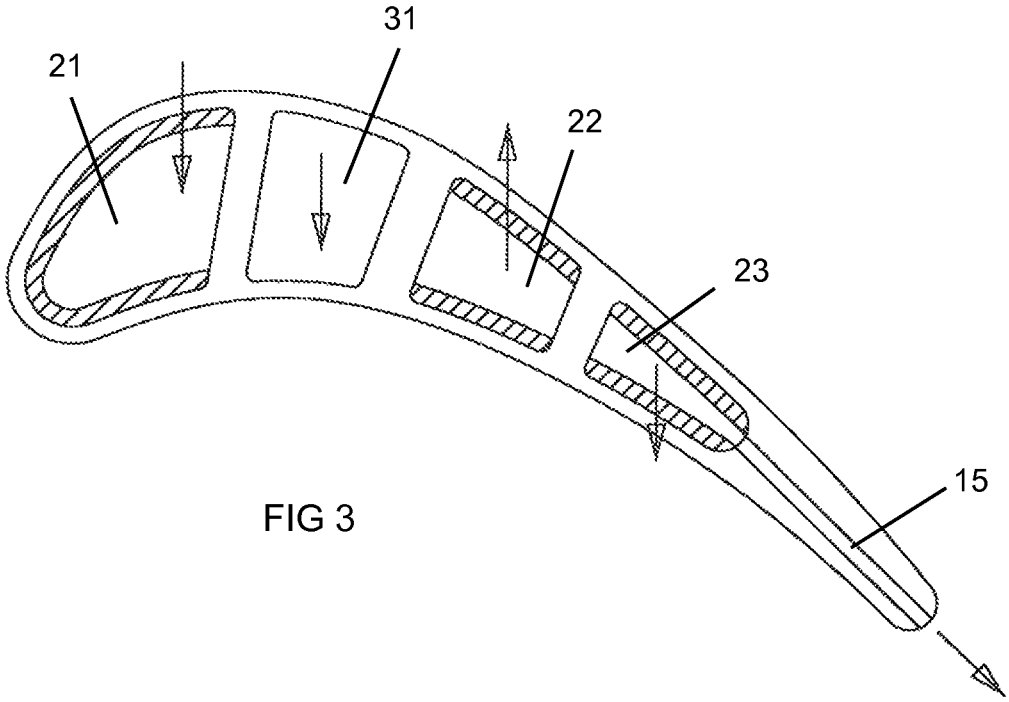
FIG. 3 shows a cross section view through the top of the vane of the present invention with the cooling circuits.
Figure 4:
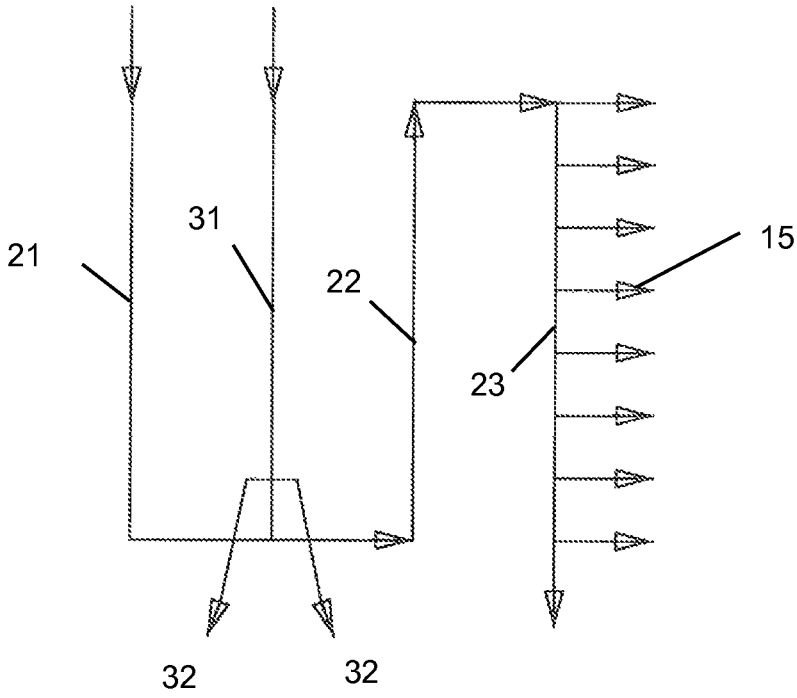
FIG. 4 shows a diagram view from the side of the vane cooling circuits of the present invention.
Figure 5:
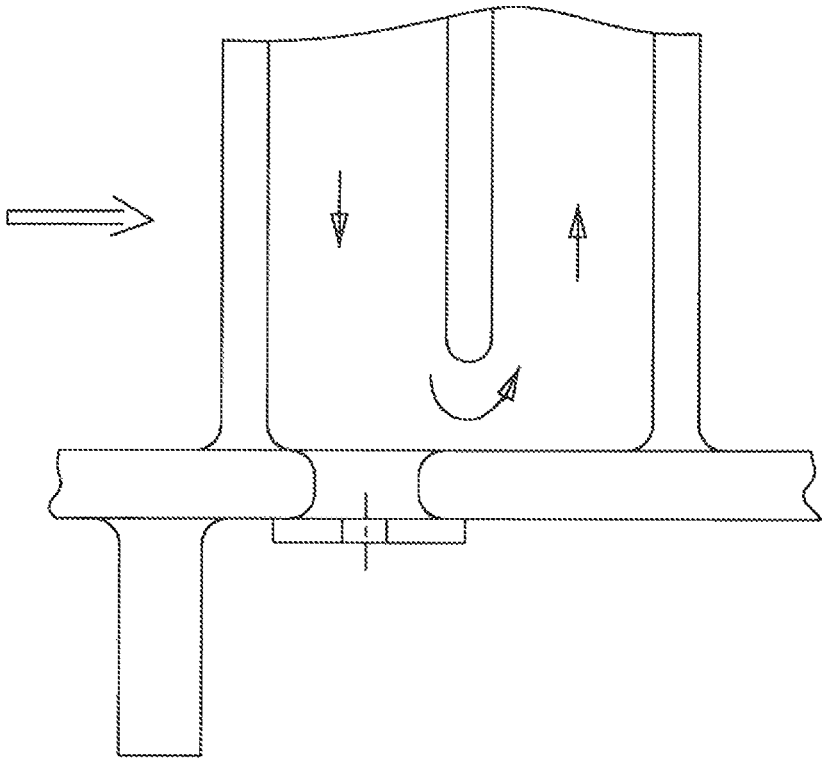
FIG 5 Prior Art
FIG. 5 shows a close-up view of a cross section for a prior art vane cooling circuit used to supply purge air to an inter-stage housing.
Figure 6:
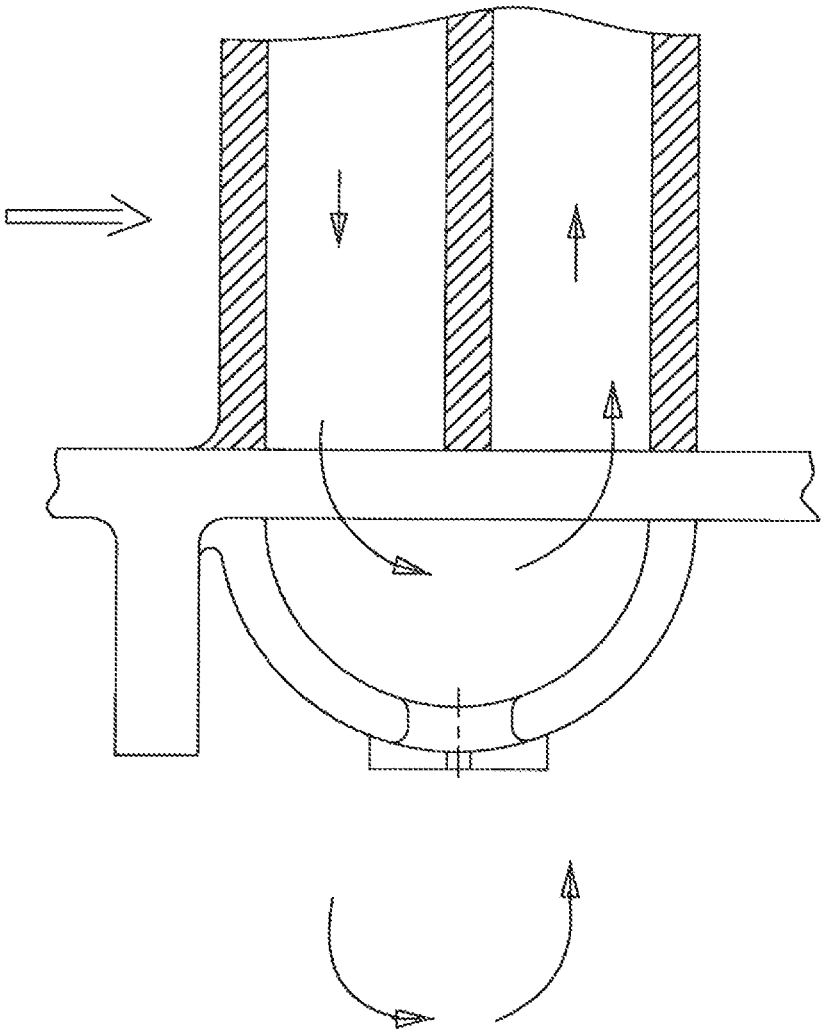
FIG 6 Prior Art
FIG. 6 shows a close-up view of a cross section for another prior art vane cooling circuit used to supply purge air to an inter-stage housing.

FIG. 3 shows a cross section top view of the airfoil cooling circuit with the purge air channel 31. The three legs 21-23 of the serpentine flow circuit include trip strips on the sides of the legs with the row of exit cooling holes 15 connected to the third leg 23. The purge air channel 31 is located between the first and second legs 21 and 22 and extends across the airfoil from the pressure side wall to the suction side wall just like the three legs 21-23 of the serpentine flow circuit. FIG. 4 shows a flow diagram of the serpentine flow cooling circuit and the purge air channel 31. The purge air channel 31 is connected to two bleed air holes 32 that open into the front side of the rim cavity and the aft side of the rim cavity formed below the inner endwall 12 and discussed in more detail below.

Figure 7:
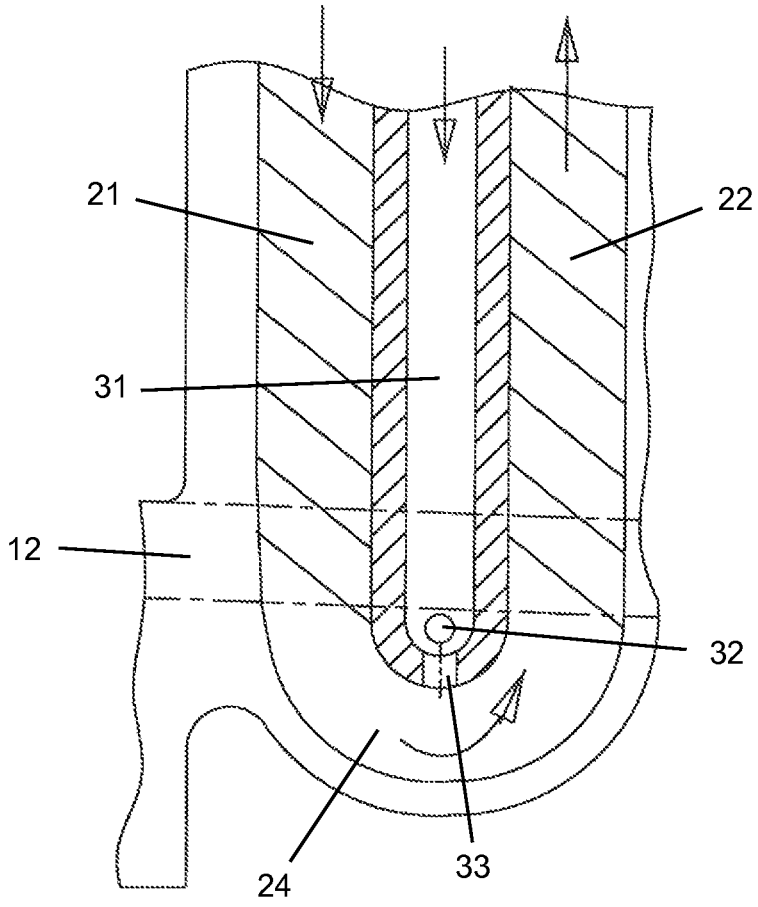
FIG. 7 shows a cross section side view at the bottom of the purge air channel between the first and second legs of the serpentine flow circuit in the vane of the present invention.

FIG. 7 shows a detailed view of the bottom end of the serpentine flow circuit and the purge air channel 31 located between the first leg 21 and the second leg 22. The lower turn channel 24 in this embodiment is located below the inner endwall 12 of the vane. One of the bleed air holes 32 connected to the lower end of the purge air channel 31 is shown in FIG. 7. A core tie hole 33 is formed on the end of the purge air channel 31 and opens into the lower turn channel 24. Some of the purge air from the purge air channel 31 is discharged through the core tie hole 33 and into the flow in the lower turn channel 24.

Figure 8:
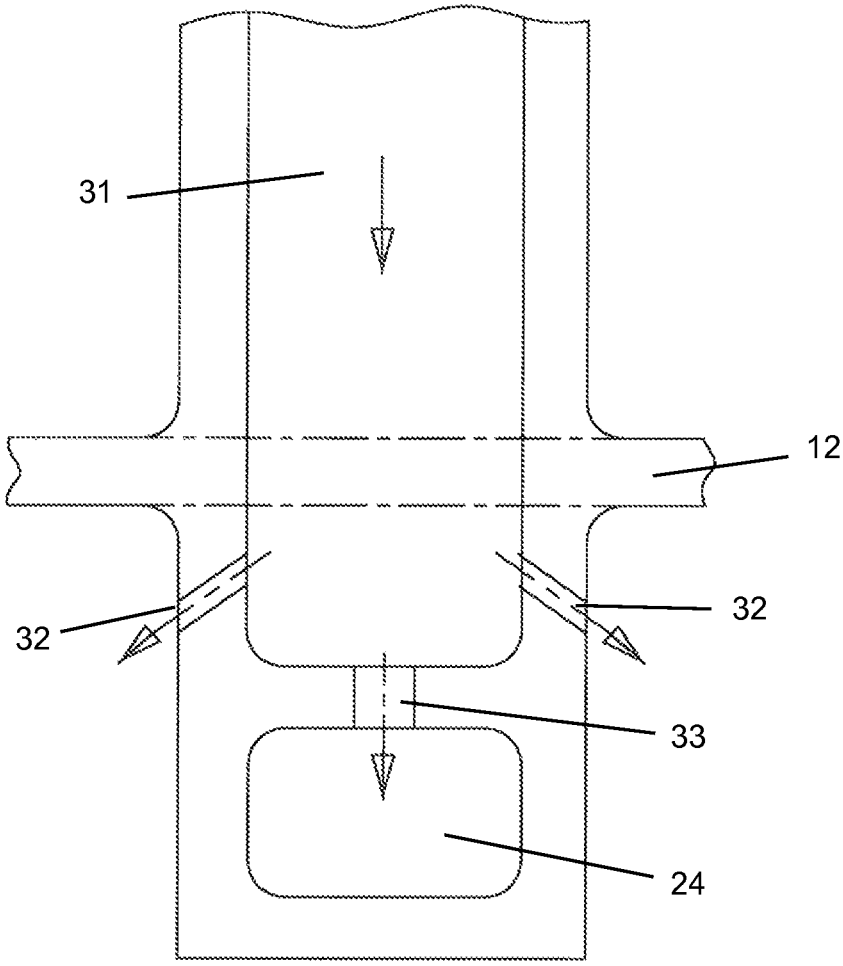
FIG. 8 shows a cross section front view of the bottom section of the purge air channel in the vane of the present invention.

FIG. 8 shows a front view of the lower section of the purge air channel 31 with the core tie hole 33 opening into the lower turn channel 24. The forward and the aft bleed holes 32 connected to the purge air channel 31 opens onto the front side of the rim cavity 27 and the aft side of the rim cavity 27 to discharge the purge air used to purge hot gas from the rim cavity 27 and to cool the inter-stage housing of the turbine.

Figure 9:
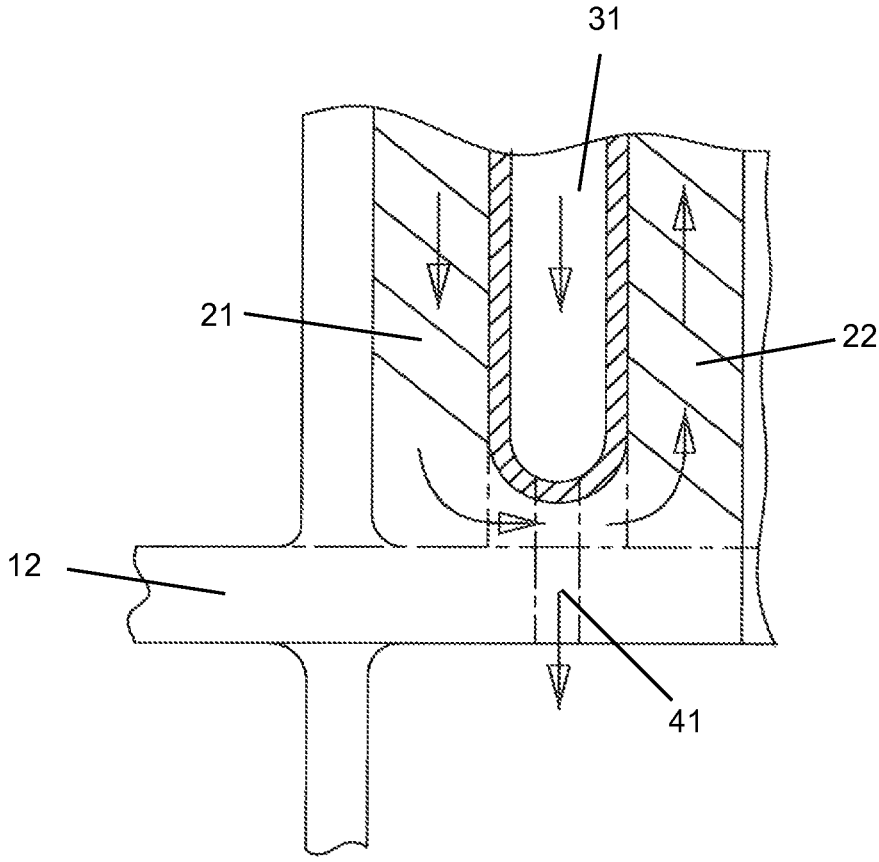
FIG. 9 shows a cross section side view of a second embodiment of the purge air channel in the vane of the present invention.
Figure 10:
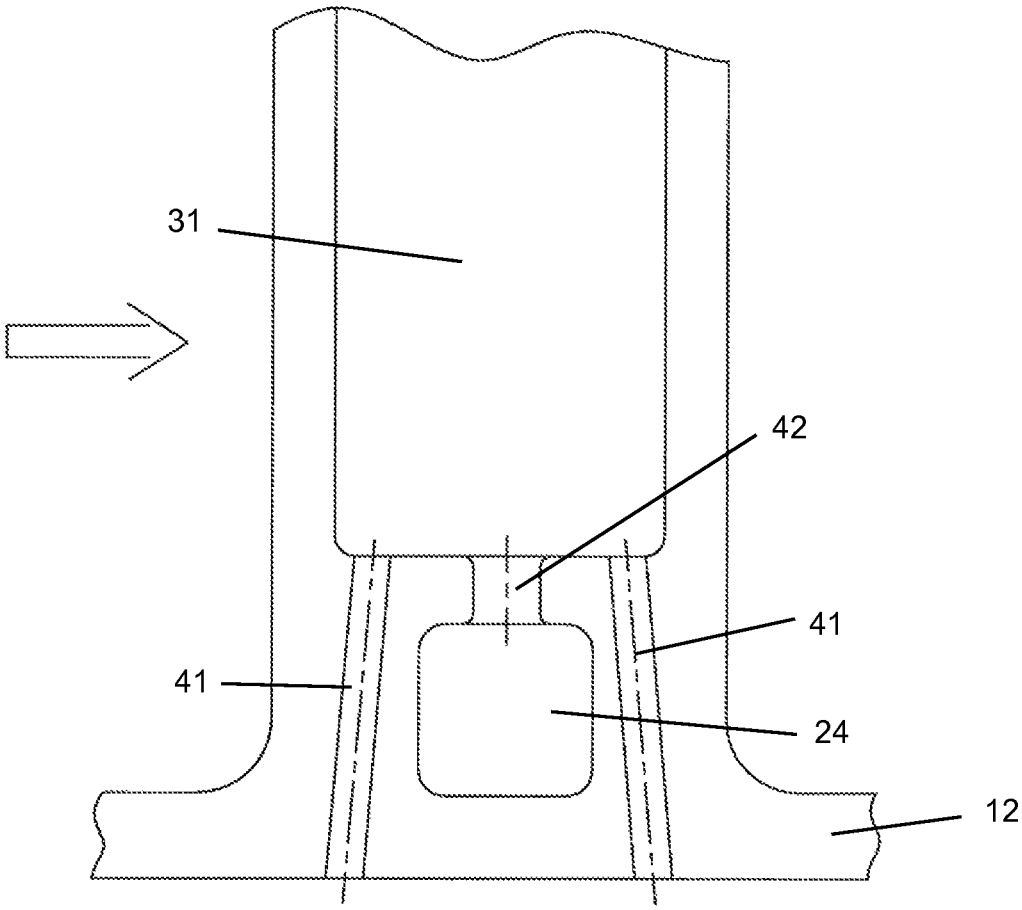
FIG. 10 shows cross section front view of the purge air channel of the FIG. 9 embodiment of the present invention.

FIG. 9 shows a second embodiment of the purge air channel 31 of the present invention in which the lower turn channel 24 is located above the inner endwall 12 of the vane. FIG. 10 shows a front view of the second embodiment with a core tie hole 42 connecting the purge air channel 31 to the lower turn channel 24. In the second embodiment, the purge air holes 41 are formed within a thicker wall in the root turn channel and open on the bottom side of the inner endwall 12 instead of one the sides of the purge air channel 31 in FIG. 8.

In the cooling circuit and purge air channel of the present invention, cooling air flows through the serpentine flow circuit to provide cooling for the airfoil of the vane. The leading edge of the airfoil (the hottest section of the airfoil) is cooled with fresh cooling air supplied from the impingement cavity 26 above the outer endwall 11 and flows first through the first leg 21 to cool the leading edge region. The purge air used to purge the rim cavity 27 below the inner endwall 12 is supplied through the purge air channel 31 which is separate from the legs of the serpentine flow circuit so that the purge air is not heated, especially from the leading edge as in the prior art. The purge air is thus cooler and therefore can provide better cooling for the inter-stage housing of the turbine. The smooth surfaces in the purge air channel 31 and the upper and lower turn channels 24 and 25 provide for low pressure loss and low heat transfer into the cooling air. For the tip turns 24 and 25, the smooth surfaces provide for a smooth flow of the air between legs without much turbulence as is produced in the legs due to the trip strips.

A majority of the purge air flowing through the purge air channel 31 flows through the bleed holes 32 and 41 and into the rim cavities 27 of the inter-stage housing for cooling and purge of the rim cavities. A small portion of the purge air is bled off into the lower turn channel 24. The core tie hole 33 and 42 is present because it is used to support the ceramic core during the casting process to form the vane.

The cooling air passing through the serpentine flow circuit passes through each leg in series with most of the cooling air passing through the trailing edge exit holes 15 to provide cooling for the trailing edge region. The remaining cooling air from the third leg 23 flows through the print-out hole 29 located at the end of the third leg 23 as additional purge air for the aft side of the rim cavity 27.

Major design features and advantages of the cooling circuit and purge air channel of the present invention are described below. The cooling air used as purge air for the rim cavity is not first used to cool the leading edge region of the airfoil, and therefore is cooler than in the prior art designs. This improves the turbine stage performance. Because the rim cavity purge air is channeled through a separate channel than the airfoil serpentine flow cooling air, no purge air is used for cooling of the airfoil that has the highest heat load. This minimizes any overheating of the cooling air used for purge of the inter-stage housing. A smooth surface is used for the purge channels with minimal heat transfer to the purge air because the purge channels are separate from the serpentine flow circuit. The separate and smooth purge channels also minimize any pressure loss due to turning within the airfoil. Using rim cavity purge air from separate cooling channels increase the design flexibility for the airfoil cooling circuit design as well as the inter-stage housing cooling system. The root discharge hole at the end of the third leg of the serpentine circuit can be used to provide additional support for the serpentine ceramic core during the casting process of the vane.

I claim the following:

1. A stator vane for an industrial gas turbine engine comprising:

an airfoil with a leading edge region and a trailing edge region;

the airfoil extending between an outer endwall and an inner endwall;

a first leg of a serpentine flow cooling circuit located along the leading edge region;

a second leg connected to the first leg through a lower turn channel;

a purge air channel formed between the first leg and the second leg;

the purge air channel having an inlet opening above the outer endwall and bleed hole opening below the inner endwall; and, the purge air channel connected to the lower turn channel through a core tie hole.

2. The stator vane of claim 1, and further comprising:

the purge air channel opens into a front side rim cavity bleed hole and an aft side rim cavity bleed hole.

3. The stator vane of claim 2, and further comprising:

the front side rim cavity bleed hole and the aft side rim cavity bleed hole both open onto sides of the purge air channel located below the inner endwall.

4. The stator vane of claim 1, and further comprising:

the purge air channel opens into a plurality of bleed holes that open onto a bottom side of the inner endwall.

5. The stator vane of claim 1, and further comprising:

the purge air channel is a smooth channel without trip strips such that a pressure loss and a heat transfer coefficient are minimal.

6. The stator vane of claim 1, and further comprising:

the lower turn channel and the upper turn channel are both smooth channels without trip strips such that a pressure loss and a heat transfer coefficient are minimal.

7. The stator vane of claim 1, and further comprising:

a print-out hole located at an end of the third leg to discharge purge air into an aft side rim cavity.

8. A process for cooling a stator vane and purging a rim cavity of a gas turbine engine, the stator vane having an airfoil extending between an inner endwall and an outer endwall, the process comprising the steps of:

passing cooling air through the airfoil in a serpentine flow path from a leading edge to a trailing edge to provide cooling for the airfoil;

passing purge air from the outer endwall to the inner endwall through a separate passage formed between adjacent channels within the airfoil from the serpentine flow path;

discharging some of the purge air into the serpentine flow path; and, discharging the remaining purge air into the rim cavity of the turbine.

9. The process for cooling a stator vane and purging a rim cavity of claim 8, and further comprising the steps of:

discharging most of the serpentine flow cooling air through exit holes in the trailing edge to provide cooling for the trailing edge region; and, discharging a remaining serpentine flow cooling air from the serpentine flow into an aft side of the rim cavity.

10. The process for cooling a stator vane and purging a rim cavity of claim 8, and further comprising the step of:

passing the purge air through the separate passage within the airfoil without imparting any turbulent flow to limit pressure loss and heat transfer to the purge air.

* * * * *